US007879120B2

(12) United States Patent
Seo et al.

(10) Patent No.: US 7,879,120 B2
(45) **Date of Patent: *Feb. 1, 2011**

(54) VACUUM CLEANER

(75) Inventors: Ji-ho Seo, Gwangju (KR); Dong-hun Yoo, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 335 days.

This patent is subject to a terminal disclaimer.

(21) Appl. No.: 12/154,580

(22) Filed: May 23, 2008

(65) Prior Publication Data

US 2009/0113861 A1 May 7, 2009

Related U.S. Application Data

(60) Provisional application No. 61/001,909, filed on Nov. 5, 2007.

(30) Foreign Application Priority Data

Feb. 14, 2008 (KR) ..... 10-2008-0013502

(51) Int. Cl.
*B01D 45/12* (2006.01)

(52) U.S. Cl. ..... 55/345; 55/337; 55/343; 55/346; 55/424; 55/447; 55/456; 55/DIG. 3; 15/352; 15/353

(58) Field of Classification Search ..... 55/337, 55/345, 343, 346, 424, 447, 456; 15/352, 15/353

See application file for complete search history.

(56) References Cited

U.S. PATENT DOCUMENTS

| | | | | |
|---|---|---|---|---|
| 3,425,192 | A | 2/1969 | Davis | 55/345 |
| 4,711,720 | A | 12/1987 | Young | 210/512.2 |
| 2002/0020154 | A1 * | 2/2002 | Yang | 55/337 |
| 2007/0199284 | A1 * | 8/2007 | Yoo et al. | 55/345 |

FOREIGN PATENT DOCUMENTS

| | | |
|---|---|---|
| DE | 1 058 470 | 6/1959 |
| GB | 2 360 719 | 10/2001 |
| KR | 10-2007-0036336 | 4/2007 |
| KR | 10-2007-0088223 | 8/2007 |

* cited by examiner

*Primary Examiner*—Jason M Greene
*Assistant Examiner*—Dung Bui
(74) *Attorney, Agent, or Firm*—Ohlandt, Greeley, Ruggiero & Perle, LLP

(57) ABSTRACT

A multi-cyclone dust-collecting apparatus for a vacuum cleaner mounted in a main cleaner body to separate dust from air flowing from a suction port body and collect the dust separated from the air, the apparatus including a dust-separating unit including a primary cyclone unit to separate large dust particles contained in the air flowing from the suction port body, and a secondary cyclone unit that is disposed inside the primary cyclone unit and that tapers downwards; and a dust-collecting unit detachably mounted in a lower portion of the dust-separating unit, the dust-collecting unit including a first dust-collecting chamber to collect the large dust particles discharged from the primary cyclone unit, and a second dust-collecting chamber disposed inside the first dust-collecting chamber to collect fine dust particles discharged from the secondary cyclone unit. The first dust-collecting chamber may be greater in volume than the second dust-collecting chamber.

15 Claims, 4 Drawing Sheets

VACUUM CLEANER

CROSS-REFERENCE TO RELATED APPLICATIONS

This application claims the benefit under 35 U.S.C. §119 (e) of U.S. Provisional Patent Application No. 61/001,909, filed on Nov. 5, 2007, in the United States Patent and Trademark Office, and claims the benefit under 35 U.S.C. §119(a) of Korean Patent Application No. 10-2008-0013502, filed on Feb. 14, 2008, in the Korean Intellectual Property Office, the entire disclosures of both of which are incorporated herein by reference.

BACKGROUND OF THE INVENTION

1. Field of the Invention

The present disclosure relates to a multi-cyclone dust-collecting apparatus, and more particularly, to a multi-cyclone dust-collecting apparatus mounted in a vacuum cleaner to separate dust from air drawn inside the vacuum cleaner in multiple stages, collect the separated dust and discharge air from which dust has been separated.

2. Description of the Related Art

Vacuum cleaners generally draw in dust-laden air on a surface being cleaned through suction inlet assemblies, separate dust from the drawn-in air, and collect the separated dust using dust-collecting apparatuses mounted therein.

Conventional dust-collecting apparatuses cause dust-laden air to whirl in order to separate dust from the dust-laden air using the centrifugal force generated by the whirling motion of the air, so that air from which dust has been separated can be discharged from the dust-collecting apparatus and the separated dust can be collected. Such dust-collecting apparatuses employ multi-cyclones to filter dust in multiple stages in order to more efficiently separate fine dust particles from air drawn into the dust-collecting apparatus.

SUMMARY OF THE INVENTION

The present disclosure has been developed in order to solve the above described and other problems in the related art. Accordingly, an aspect of the present disclosure is to provide a multi-cyclone dust-collecting apparatus for a vacuum cleaner that is able to increase the overall dust-collecting efficiency and facilitate maintenance and repair.

The above aspect is achieved by providing a multi-cyclone dust-collecting apparatus for a vacuum cleaner mounted in a main cleaner body to separate dust from air flowing from a suction port body, and collect the dust separated from the air, the apparatus including a dust-separating unit including a primary cyclone unit to separate large dust particles contained in the air flowing from the suction port body, and a secondary cyclone unit that is disposed inside the primary cyclone unit and that tapers downwards; and a dust-collecting unit detachably mounted in a lower portion of the dust-separating unit, the dust-collecting unit including a first dust-collecting chamber to collect the large dust particles discharged from the primary cyclone unit, and a second dust-collecting chamber disposed inside the first dust-collecting chamber to collect fine dust particles discharged from the secondary cyclone unit. The first dust-collecting chamber may be greater in volume than the second dust-collecting chamber.

The secondary cyclone unit may include a plurality of cone-shaped cyclones disposed around the circumference thereof, and the plurality of cone-shaped cyclones may be inclined so that lower ends thereof may face the center of the secondary cyclone unit. Accordingly, the diameter of the second dust-collecting chamber corresponding to the secondary cyclone unit may decrease, but the dust-collecting capacity of the first dust-collecting chamber may increase, and accordingly it is possible to reduce the number of times a user needs to empty the dust-collecting unit.

Additionally, a discharge port of the primary cyclone unit may perform the same function as an inlet port of the secondary cyclone unit. Therefore, it is possible to omit a connection path connecting the primary cyclone unit to the secondary cyclone unit, so pressure loss caused by the connection path may be reduced.

The inlet port of the secondary cyclone unit may be disposed in a direction opposite the direction of the airflow formed inside the primary cyclone unit, and it is thus possible to prevent large dust particles from flowing into the secondary cyclone unit.

The secondary cyclone unit may be detachably disposed inside the primary cyclone unit. In this situation, the secondary cyclone unit may be connected to the primary cyclone unit by a connection member having a plurality of discharge pipes into which air discharged from the secondary cyclone unit flows. Additionally, the plurality of discharge pipes may be inclined inside the plurality of cone-shaped cyclones on the same axis as that on which the plurality of cone-shaped cyclones are disposed.

The dust-collecting unit may further include a cylindrical partition formed on the inside thereof to divide the dust-collecting unit into the first dust-collecting chamber and second dust-collecting chamber. An upper end of the cylindrical partition may be engaged with a lower end of the secondary cyclone unit so as to cause the primary cyclone unit and the secondary cyclone unit to be separated.

The primary cyclone unit may include a body that is formed integrally with an inlet pipe and that has an open lower portion, wherein the inlet pipe is disposed at a tangent to one side of the body; and an outlet pipe, one side of which is able to fluidly communicate with an upper portion of the body.

The secondary cyclone unit may be detachably connected to the primary cyclone unit by a connection member having a plurality of discharge pipes into which air discharged from the secondary cyclone unit flows. The connection member may be detachably connected to the body and the outlet pipe. Therefore, a user may easily assemble and disassemble the dust-separating unit including a small number of units.

BRIEF DESCRIPTION OF THE DRAWINGS

The above aspects and other advantages of the present disclosure will be more apparent by describing exemplary embodiments of the present disclosure with reference to the accompanying drawing figures, in which.

Throughout the drawings, like reference numerals will be understood to refer to like parts, components and structures.

DETAILED DESCRIPTION OF EXEMPLARY EMBODIMENTS

Hereinafter, a multi-cyclone dust-collecting apparatus for a vacuum cleaner according to an exemplary embodiment of the present disclosure will now be described in greater detail with reference to the accompanying drawing figures.

Figure 1:
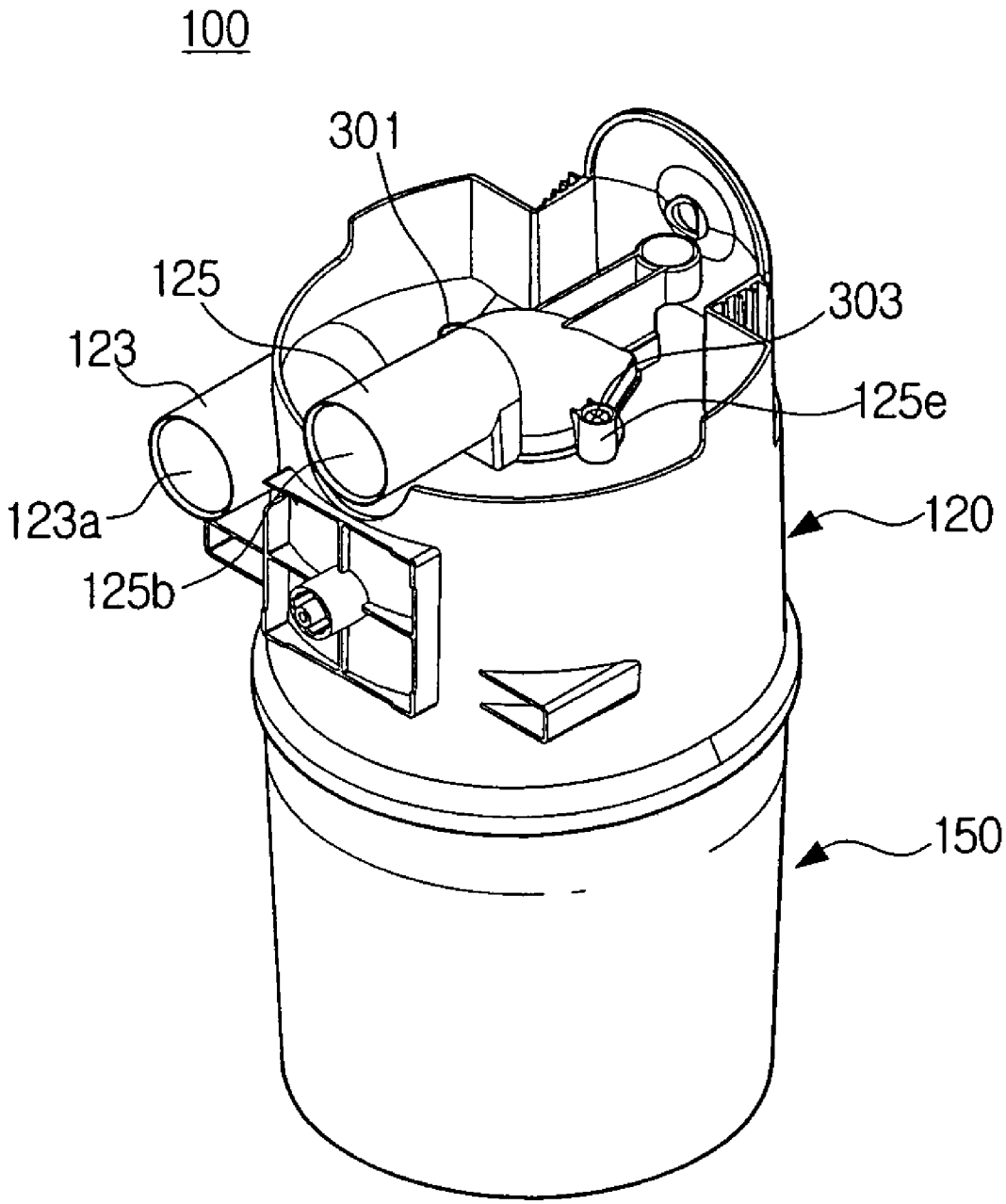
FIG.1 is a perspective view showing a multi-cyclone dust-collecting apparatus according to an exemplary embodiment of the present disclosure.

Referring to FIG. 1, a multi-cyclone dust-collecting apparatus 100 according to an exemplary embodiment of the present disclosure includes a dust-separating unit 110 to separate large dust particles and fine dust particles, in sequence, from air flowing into a main cleaner body (not shown) through a suction port assembly (not shown), and a dust-collecting unit 150 to collect the large and fine dust particles separated by the dust-separating unit 110.

Figure 2:
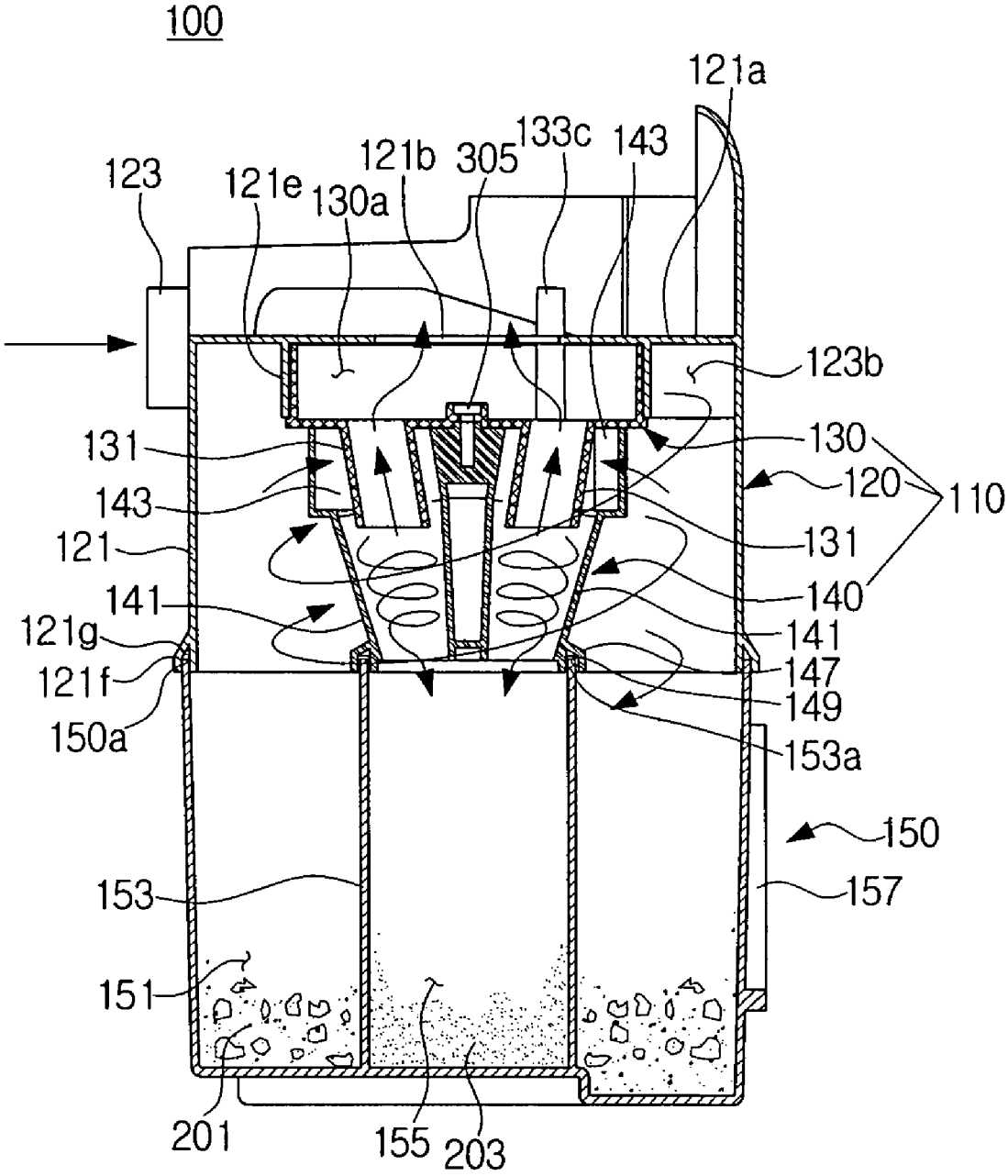
FIG. 2 is a cross-sectional view showing a multi-cyclone dust-collecting apparatus wherein an outflow pipe is omitted, according to an exemplary embodiment of the present disclosure.
Figure 3:
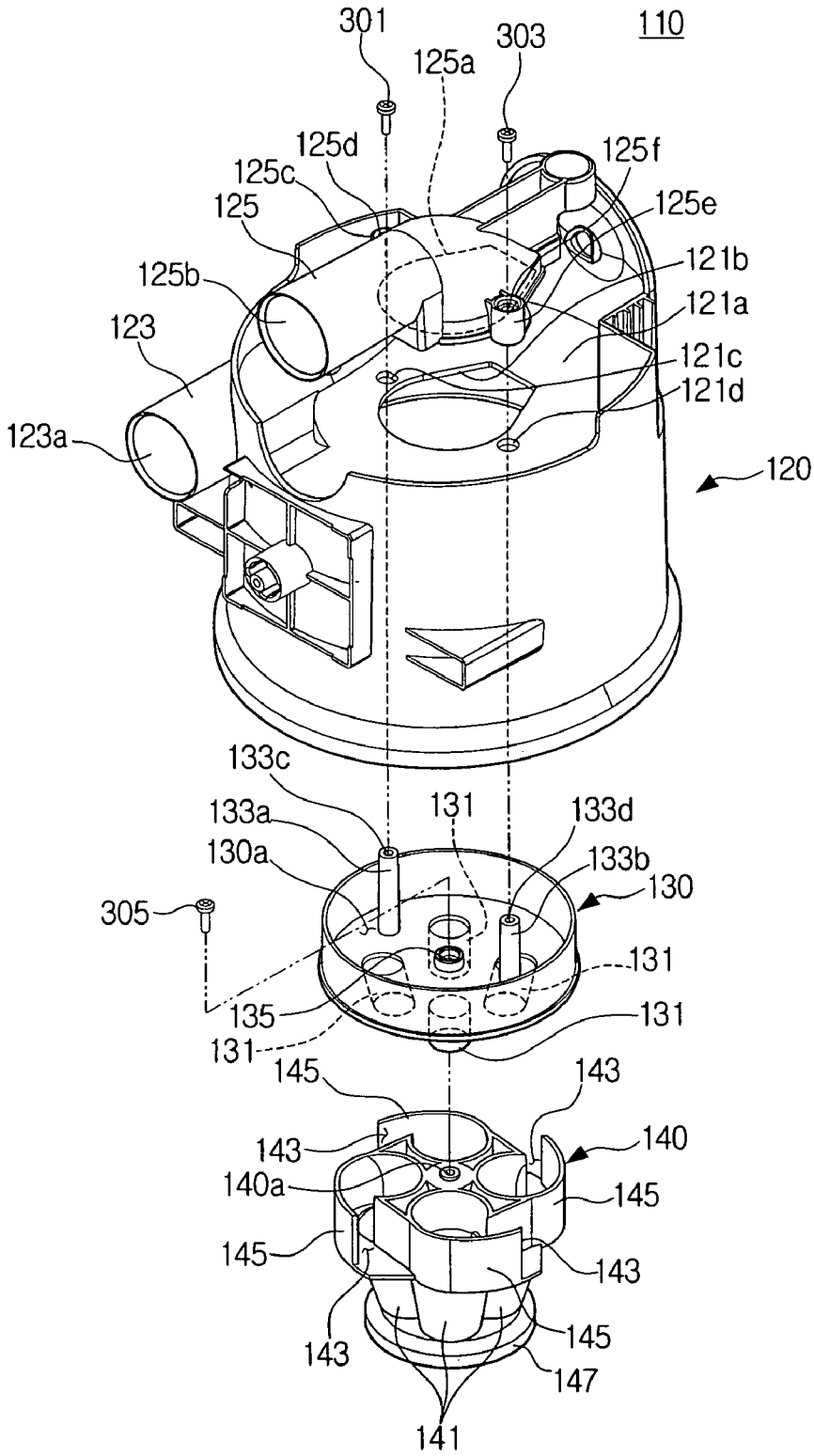
FIG. 3 is an exploded, perspective view showing a dust-separating unit of a multi-cyclone dust-collecting apparatus according to an exemplary embodiment of the present disclosure.

Referring to FIGS. 2 and 3, the dust-separating unit 110 includes a primary cyclone unit 120, a connection member 130, and a secondary cyclone unit 140.

The primary cyclone unit 120 includes a body 121, an inflow pipe 123, and an outflow pipe 125.

The body 121 is configured in a substantially cylindrical shape, with an open lower portion, and includes a top plate 121*a* formed on a top portion. The top plate 121*a* includes a discharge port 121*b* that is formed substantially in the center thereof and through which air is discharged from the body 121 through the connection member 130. Additionally, the top plate 121*a* includes penetration holes 121*c* and 121*d* formed adjacent to the discharge port 121*b*, and a cylindrical projection 121*e* engaged with an upper portion of the connection member 130.

The inflow pipe 123 is disposed on a suction path between a suction port body (not shown) and the body 121, and at a tangent to one side of an upper portion of the body 121. The inflow pipe 123 includes an inflow pipe inlet port 123*a* formed on one side in fluid communication with the suction port body (not shown) and an inflow pipe discharge port 123*b* on the opposite side in fluid communication with the body 121. Since the inflow pipe 123 is disposed at a tangent to one side of an upper portion of the body 121 as described above, the inflow pipe 123 causes dust-laden air drawn into the body 121 to whirl so that large dust particles 201 are separated from the dust-laden air using the centrifugal force generated by the whirling motion of the air.

The outflow pipe 125 is disposed on a discharge path between the body 121 and a suction motor (not shown) to guide air discharged from the discharge port 121*b* of the body 121 after filtration, toward the suction motor (not shown) of the main cleaner body (not shown). The outflow pipe 125 includes an outflow pipe inlet port 125*a* disposed on one side that is connected to the top plate 121*a* of the body 121 and that fluidly communicates with the discharge port 121*b* of the body 121. The outflow pipe 125 also includes an outflow pipe discharge port 125*b* disposed on the opposite side in fluid communication with the suction motor (not shown). Additionally, the outflow pipe 125 includes extension projections 125*c* and 125*e* adjacent to the outflow pipe inlet port 125*a*. The extension projections 125*c* and 125*e* include extending projection engaging holes 125*d* and 125*f* into which screws 301 and 303 are inserted to engage the extension projections 125*c* and 125*e* with upper ends of connection projections 133*a* and 133*b* of the connection member 130.

The connection member 130 is configured in a substantially cylindrical shape and engaged with the cylindrical projection 121*e* of the top plate 121*a*, so that the secondary cyclone unit 140 is mounted inside the primary cyclone unit 120. The connection member 130 includes a plurality of discharge pipes 131 extending downward from a lower portion around the circumference thereof. Lower ends of the plurality of discharge pipes 131 are inclined towards the center of the connection member 130. Additionally, the connection member 130 includes the connection projections 133*a* and 133*b* having connection projection engaging holes 133*c* and 133*d* on upper ends thereof with which the screws 301 and 303 are engaged. The connection projections 133*a* and 133*b* are connected to the extension projections 125*c* and 125*e* through the penetration holes 121*c* and 121*d* of the body 121. The connection member 130 fixes the secondary cyclone unit 140 to the lower portion of the connection member 130 using an engagement screw 305. In this situation, the engagement screw 305 is inserted into a connection member center hole 135 formed on the center of the connection member 130. The connection member 130 houses an air chamber 130*a* in which air discharged from a plurality of cone-shaped cyclones 141 through the plurality of discharge pipes 131 accumulates.

The secondary cyclone unit 140 includes a secondary cyclone center hole 140*a* formed on the center of an upper surface thereof, into which the engagement screw 305 is inserted. The secondary cyclone unit 140 further includes the plurality of cone-shaped cyclones 141 that are formed integrally with each other around the circumference of the secondary cyclone unit 140 and each of which tapers downwards. The plurality of cone-shaped cyclones 141 are inclined by a predetermined angle so that lower ends thereof face the center of the secondary cyclone unit 140. When the connection member 130 is engaged with the secondary cyclone unit 140 by the engagement screw 305, the plurality of discharge pipes 131 of the connection member 130 are inserted into the plurality of cone-shaped cyclones 141, respectively. Here, the plurality of discharge pipes 131 are positioned on the same axis as that on which the plurality of cone-shaped cyclones 141 are disposed. The dust-collecting unit 150 includes a first dust-collecting chamber 151 and a second dust-collecting chamber 155. As the lower ends of the plurality of cone-shaped cyclones 141 face the center of the secondary cyclone unit 140, the diameter D of the second dust-collecting chamber 155 for collecting fine dust particles 203 decreases, but the capacity of the first dust-collecting chamber 151 increases. Accordingly, the amount of the large dust particles 201 that may be collected during cleaning is greater than that of fine dust particles 203. If the first dust-collecting chamber 151 for collecting large dust particles 201 increases in width, there is no need for a user to frequently discharge dust that has collected in the dust-collecting unit 150.

The secondary cyclone unit 140 includes a plurality of guide units 145 to form a plurality of secondary cyclone inlet ports 143, which force air passing from the primary cyclone unit 120 into the plurality of cone-shaped cyclones 141. The plurality of guide units 145 are disposed in a direction opposite that of the airflow inside the body 121 of the primary cyclone unit 120. Accordingly, the large dust particles 201 flowing into the primary cyclone unit 120 may be made to collect in the first dust-collecting chamber 151 of the dust-collecting unit 150 by the centrifugal force, rather than flowing directly into the secondary cyclone inlet ports 143 of the secondary cyclone unit 140. Additionally, the secondary cyclone inlet ports 143 of the secondary cyclone unit 140 may also have the function of discharging air from the primary cyclone unit 120, so it is possible to prevent pressure loss resulting from an increase in length of the discharge ports of the primary cyclone unit 120 and the secondary cyclone inlet ports 143 of the secondary cyclone unit 140.

Furthermore, the secondary cyclone unit 140 includes a secondary cyclone insertion groove 149 along a lower end 147 thereof into which an upper end 153*a* of a cylindrical partition 153 is inserted. Accordingly, if the primary and secondary cyclone units 120 and 140 concurrently separate dust when the upper end 153*a* of the cylindrical partition 153 is inserted into the secondary cyclone insertion groove 149 of the secondary cyclone unit 140, the airflow formed in the primary cyclone unit 120 does not affect the secondary cyclone unit 140 because the secondary cyclone unit 140 is completely partitioned from the primary cyclone unit 120.

In the above exemplary embodiment, the dust-separating unit 110 includes four components, namely the body 121, outflow pipe 125, connection member 130 and secondary cyclone unit 140, which are engaged using the screws 301, 303 and 305. Accordingly, the dust-separating unit 110 may be easily assembled or disassembled, facilitating efficient maintenance and repair. Additionally, the outflow pipe 125 may be formed integrally with the body 121, so the dust-separating unit 110 may be configured with three components.

Figure 4:
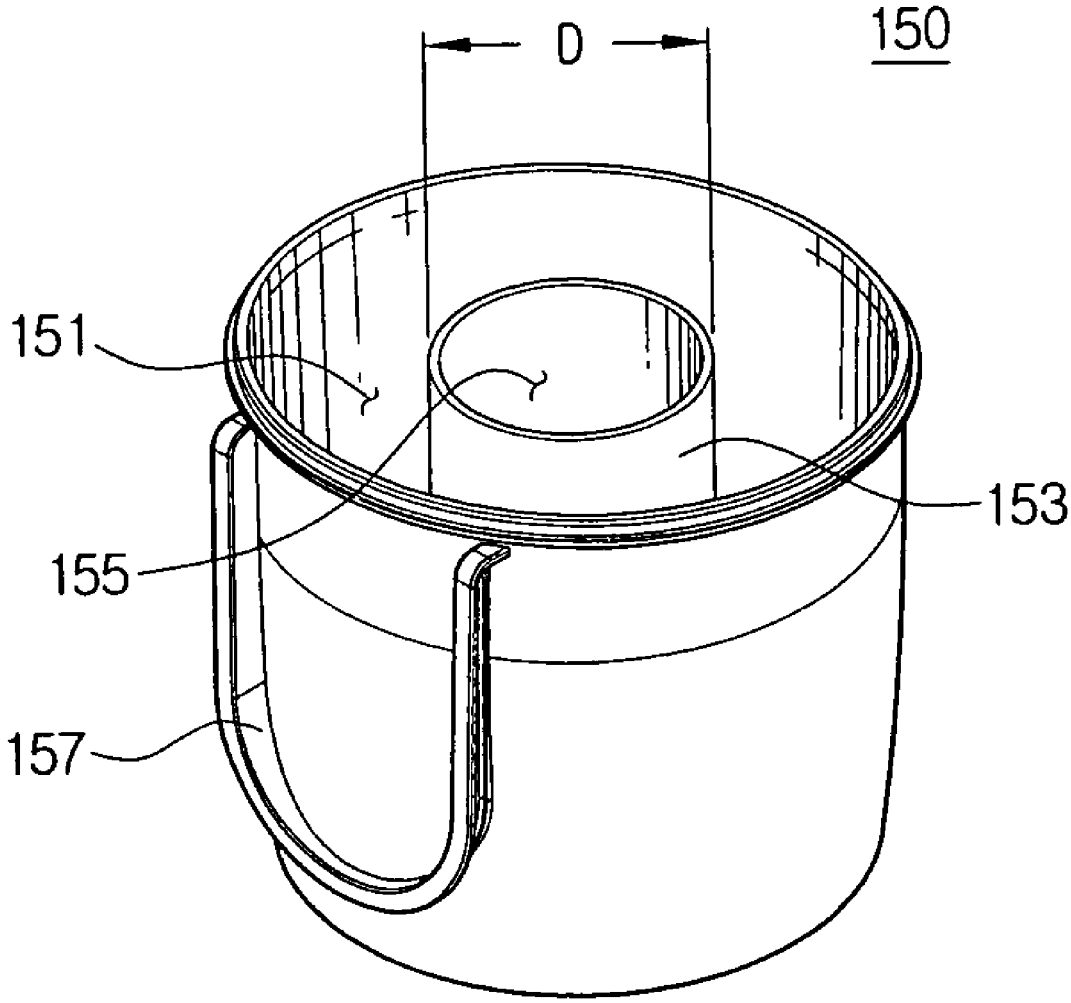
FIG. 4 is a perspective view showing a dust-collecting unit of a multi-cyclone dust-collecting apparatus according to an exemplary embodiment of the present disclosure.

Referring to FIGS. 2 and 4, the cylindrical partition 153 extends vertically from the center of the dust-collecting unit 150, to divide the dust-collecting unit 150 into the first dust-collecting chamber 151 and the second dust-collecting chamber 155. Accordingly, the first dust-collecting chamber 151 is formed as a space between the outside of the partition 153 and the inside of the body 121 in order to collect the large dust particles 201, and the second dust-collecting chamber 155 is formed as a space inside the partition 153 in order to collect the fine dust particles 203.

An upper end 150*a* of the dust-collecting unit 150 is inserted and fitted into a body insertion groove 121*g* formed along a lower end 121*f* of the body 121. The dust-collecting unit 150 includes a grip unit 157 disposed on an outer surface to grip the dust-collecting unit 150 when the dust-collecting unit 150 is detached from the main cleaner body (not shown).

The operation of the multi-cyclone dust-collecting apparatus 100 according to an exemplary embodiment of the present disclosure will be described in detail below.

Air containing dust drawn into the suction port body (not shown) flows into the multi-cyclone dust-collecting apparatus 100 along a suction path. The large dust particles 201 are separated from the air flowing in the multi-cyclone dust-collecting apparatus 100, and subsequently the fine dust particles 203 are separated. The air from which both large and fine dust particles 201 and 203 have been separated is discharged from the multi-cyclone dust-collecting apparatus 100 along the discharge path. Hereinafter, a process for sequentially separating the large and fine dust particles 201 and 203 from the air will be described with reference to FIG. 2.

Air containing dust drawn into the inflow pipe inlet port 123*a* is discharged to the inflow pipe discharge port 123*b* while whirling inside the body 121 of the primary cyclone unit 120 using a predetermined whirling force. Accordingly, the large dust particles 201 contained in the air may be separated from the air by the centrifugal force, and the separated large dust particles 201 may drop due to gravity and may collect in the first dust-collecting chamber 151 of the dust-collecting unit 150.

Subsequently, air from which the large dust particles 201 have been separated flows into the plurality of cone-shaped cyclones 141 through the plurality of secondary cyclone inlet ports 143. In this situation, a predetermined whirling force may be generated by the plurality of guide units 145 disposed at a tangent to the plurality of cone-shaped cyclones 141.

While the air flowing into the plurality of cone-shaped cyclones 141 whirls, the fine dust particles 203, which are lighter in weight than the large dust particles 201, are separated from the air using the centrifugal force generated by the whirling motion of the air, and the separated fine dust particles 203 may drop due to gravity. Accordingly, the fine dust particles 203 discharged from the plurality of cone-shaped cyclones 141 may collect in the second dust-collecting chamber 155 of the dust-collecting unit 150.

Next, air from which the fine dust particles 203 have been separated gathers in the air chamber 130*a* through the plurality of discharge pipes 131 of the connection member 130, and then flows to the outflow pipe inlet port 125*a* connected to the discharge port 121*b* of the body 121. The air filtered in the manner described above flows into the suction motor (not shown) through the outflow pipe discharge port 125*b* along the discharge path.

As described above, according to the exemplary embodiments of the present disclosure, when the lower ends of a secondary cyclone unit face the center, the second dust-collecting chamber for collecting fine dust particles dropped from the secondary cyclone unit may be reduced in volume, so the first dust-collecting chamber for collecting large dust particles separated by the primary cyclone unit may be enlarged. Therefore, it is possible to reduce the number of times a user needs to empty the dust-collecting unit.

Additionally, the discharge port of the primary cyclone unit may perform the same functions as the inlet port of the secondary cyclone unit, so if the connection path connecting the primary cyclone unit to the secondary cyclone unit is omitted, pressure loss caused by the connection path may be reduced and the overall dust-collecting efficiency of the dust-collecting apparatus may be increased.

Furthermore, the dust-collecting apparatus includes a small number of units, so it is easy to assemble and disassemble the dust-collecting apparatus. Thus, maintenance and repair can be performed more easily.

Although representative exemplary embodiments of the present disclosure have been shown and described in order to exemplify the principle of the present disclosure, the present disclosure is not limited to the specific exemplary embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A multi-cyclone dust-collecting apparatus for a vacuum cleaner mounted in a main cleaner body to separate dust from air flowing from a suction port body and collect the dust separated from the air, the apparatus comprising:

a dust-separating unit comprising a primary cyclone unit to separate large dust particles contained in the air flowing from the suction port body, and a secondary cyclone unit that is disposed inside the primary cyclone unit and that tapers downwards; and a dust-collecting unit detachably mounted in a lower portion of the dust-separating unit, the dust-collecting unit comprising a first dust-collecting chamber to collect the large dust particles discharged from the primary cyclone unit, and a second dust-collecting chamber disposed inside the first dust-collecting chamber to collect fine dust particles discharged from the secondary cyclone unit, wherein the first dust-collecting chamber is greater in volume than the second dust-collecting chamber, and wherein the secondary cyclone unit comprises a plurality of cone-shaped cyclones disposed around the circumference thereof, and the plurality of cone-shaped cyclones are inclined so that lower ends thereof face the center of the secondary cyclone unit.

2. The apparatus according to claim 1, wherein a discharge port of the primary cyclone unit performs the same function as an inlet port of the secondary cyclone unit.

3. The apparatus according to claim 1, wherein the inlet port of the secondary cyclone unit is disposed in a direction opposite the direction of the airflow formed inside the primary cyclone unit.

4. The apparatus according to claim 1, wherein the secondary cyclone unit is detachably disposed inside the primary cyclone unit.

5. The apparatus according to claim 4, wherein the secondary cyclone unit is connected to the primary cyclone unit by a connection member having a plurality of discharge pipes into which air discharged from the secondary cyclone unit flows.

6. The apparatus according to claim 5, wherein the plurality of discharge pipes are inclined inside the plurality of cone-shaped cyclones on the same axis as that on which the plurality of cone-shaped cyclones are disposed.

7. The apparatus according to claim 1, wherein the dust-collecting unit further comprises a cylindrical partition formed on the inside thereof to divide the dust-collecting unit into the first dust-collecting chamber and second dust-collecting chamber.

8. The apparatus according to claim 7, wherein an upper end of the cylindrical partition is engaged with a lower end of the secondary cyclone unit so as to cause the primary cyclone unit and the secondary cyclone unit to be separated.

9. The apparatus according to claim 1, wherein the primary cyclone unit comprises:

a body that is formed integrally with an inlet pipe and that has an open lower portion, wherein the inlet pipe is disposed at a tangent to one side of the body; and an outlet pipe, one side of which is able to fluidly communicate with an upper portion of the body.

10. The apparatus according to claim 9, wherein the secondary cyclone unit is detachably connected to the primary cyclone unit by a connection member having a plurality of discharge pipes into which air discharged from the secondary cyclone unit flows, and the connection member is detachably connected to the body and the outlet pipe.

11. A multi-cyclone dust-collecting apparatus, comprising:

a primary cyclone unit to separate large dust particles contained in flowing air;

a secondary cyclone unit disposed inside the primary cyclone unit to separate large dust particles contained in the flowing air; and a dust-collecting unit comprising a cylindrical partition formed on an inside thereof to divide the dust-collecting unit into a first dust-collecting chamber and a second dust-collecting chamber, the first dust-collecting chamber being positioned to collect the large dust particles discharged from the primary cyclone unit and the second dust-collecting chamber being positioned to collect fine dust particles discharged from the secondary cyclone unit, wherein an upper end of the cylindrical partition is engaged with a lower end of the secondary cyclone unit so as to cause the primary cyclone unit and the secondary cyclone unit to be separated, and wherein the secondary cyclone unit comprises a plurality of cone-shaped cyclones disposed around the circumference thereof, and the plurality of cone-shaped cyclones are inclined so that lower ends thereof face the center of the secondary cyclone unit.

12. The apparatus according to claim 11, wherein the first dust-collecting chamber is greater in volume than the second dust-collecting chamber.

13. The apparatus according to claim 11, wherein the secondary cyclone unit is detachably disposed inside the primary cyclone unit.

14. The apparatus according to claim 13, wherein the secondary cyclone unit is connected to the primary cyclone unit by a connection member having a plurality of discharge pipes into which air discharged from the secondary cyclone unit flows.

15. The apparatus according to claim 14, wherein the plurality of discharge pipes are inclined inside the plurality of cone-shaped cyclones on the same axis as that on which the plurality of cone-shaped cyclones are disposed.

* * * * *